US005581924A

United States Patent [19]

Peterson

[11] Patent Number: 5,581,924

[45] Date of Patent: Dec. 10, 1996

[54] POCKET-STYLE IDENTIFICATION BRACELET

[75] Inventor: Dean D. Peterson, Canoga Park, Calif.

[73] Assignee: Precision Dynamics Corporation, San Fernando, Calif.

[21] Appl. No.: 558,457

[22] Filed: Nov. 16, 1995

Related U.S. Application Data

[63] Continuation of Ser. No. 490,096, Jun. 6, 1995, abandoned, which is a continuation of Ser. No. 91,275, Jul. 15, 1993, abandoned.

[51] Int. Cl.[6] ..... G09F 3/10; G09F 3/18

[52] U.S. Cl. ..... 40/633; 40/665

[58] Field of Search ..... 40/633, 299, 625, 40/776, 6, 665

[56] References Cited

U.S. PATENT DOCUMENTS 4,314,415 2/1982 De Woskin ..... 40/633

FOREIGN PATENT DOCUMENTS 1227497 4/1971 United Kingdom ..... 40/633
2067506 7/1981 United Kingdom ..... 40/633
2160492 12/1985 United Kingdom ..... 40/633

*Primary Examiner*—Timothy Thorpe
*Assistant Examiner*—William Wicker
*Attorney, Agent, or Firm*—Thomas P. Mahoney

[57] ABSTRACT

A laminated identification bracelet which incorporates a window type pocket created by not adhering the pocket area of the lamina which incorporates it to the underlying lamina.

17 Claims, 1 Drawing Sheet

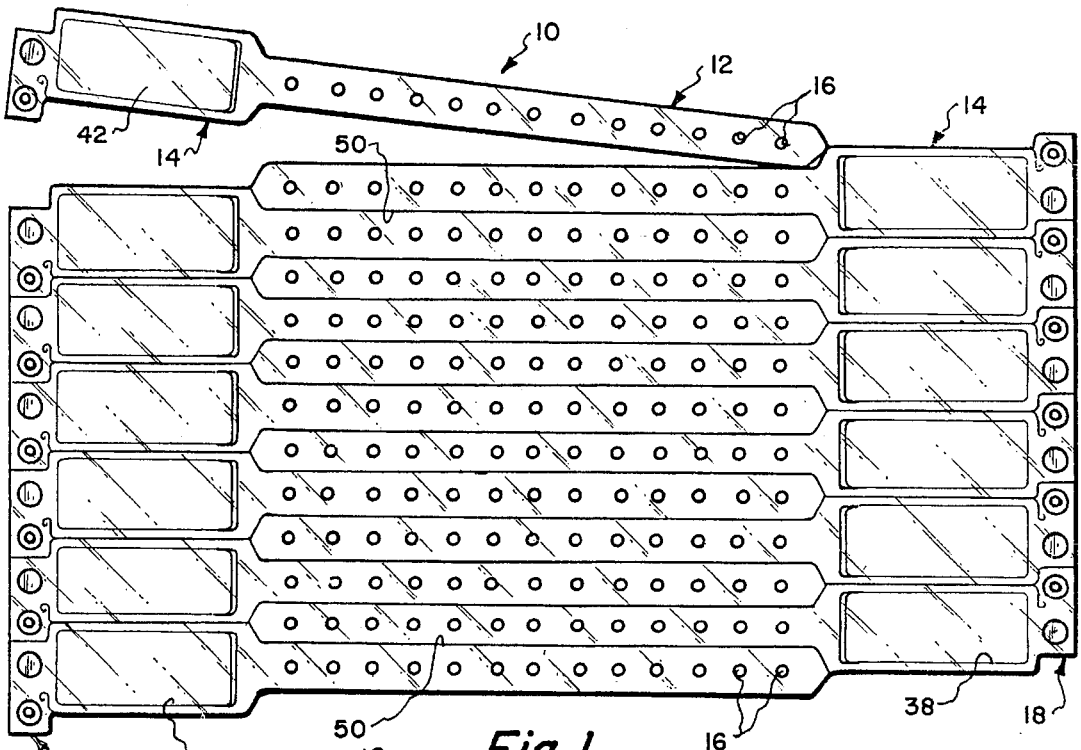
Fig. 1.
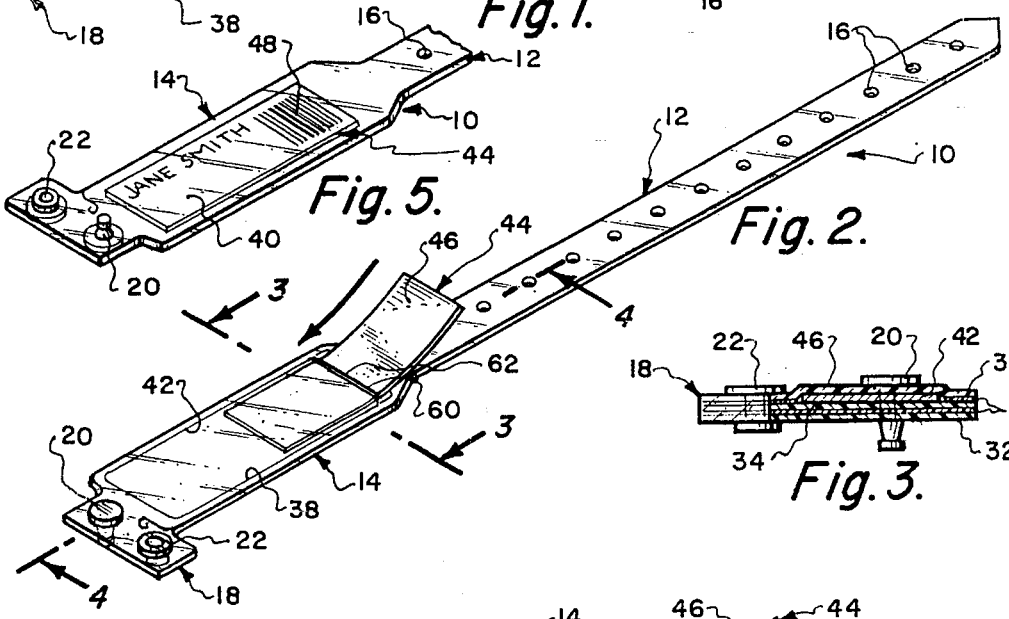
Fig. 5.
Fig. 2.
Fig. 3.
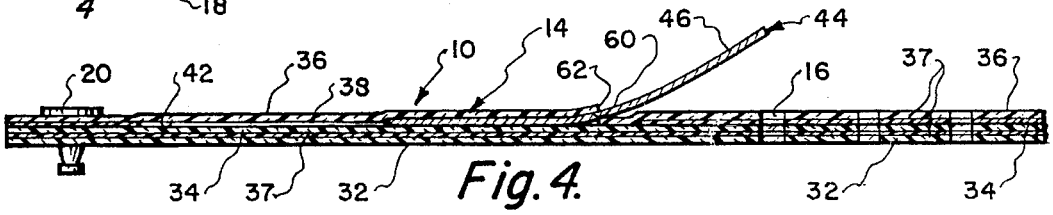
Fig. 4.

POCKET-STYLE IDENTIFICATION BRACELET

This application is a continuation of application Ser. No. 08/490,096 filed on Jun. 6, 1995, now abandoned, which was a continuation of application Ser. No. 08/091,275, filed on Jul. 15, 1993 now abandoned.

This invention relates to identification devices and is embodied in an identification band or bracelet which is intended for multiple uses including hospital patient identification, article identification, crowd control where individuals in attendance at concerts or festivals are provided with identification bands or bracelets and numerous other uses and applications.

BACKGROUND OF THE INVENTION

Identification devices or bracelets of the type under consideration here are conventionally manufactured from synthetic plastic sheet material with the sheets being adhered or secured to each or one another by heat sealing or adhesive means. Therefrom laminates are fabricated which constitute the raw material for forming the identification devices or bracelets in the requisite configuration.

Conventionally, such devices or bracelets are provided in configurations incorporating strap portions and identification portions, cooperating fastener means being provided on the devices or bracelets to secure them to the objects or persons being identified.

In bracelets or devices such as those under consideration here, a pocket is formed at the identification portion of the bracelets for the reception of information means which is associated with the object or individual identified by the bracelet.

Prior art devices incorporate pockets which are fabricated from a separate, partial lamina of suitable sheet material which is secured in overlying relationship with the previously described laminate structure. Such laminate structures can include two or more sheets secured in the aforementioned manner to which is applied the subsequent partial sheet defining the pocket structures.

Providing the pockets in this manner entails the use of additional material and, frequently, the necessity for the performance of additional manufacturing steps to secure the pocket material to the surface of the previously fabricated laminate.

These additional steps increase the cost of fabricating the bracelets and, also, increase the thickness of the bracelet at the identification portion of the bracelet rendering it less flexible at that portion than at the other portions of the bracelet.

OBJECTS AND ADVANTAGES OF THE INVENTION

It is, therefore, an object of my invention to provide an identification bracelet or device which consists of a plurality of lamina in a bracelet configuration wherein the bracelet has strap and identification portions, the pocket of said bracelet being provided by an outer laminate of said plurality subsequently to the lamina process.

A corresponding object of my invention is the provision of a bracelet of the aforementioned character in which the pocket lamina is transparent so that a window portion will be provided on the identification bracelet.

A further object of my invention is the provision of a window portion on the transparent lamina which is created in the identification portion of the bracelet by creating a gap in the adhesive utilized to secure the laminae together and which is equal in size to the desired pocket size.

Another object of my invention is the provision, in a device of the aforementioned character, of access means to said pocket provided by a slit formed in one of said laminae which permits the insertion of information means into underlying relationship with said window and containment in the pocket defined thereby.

An additional object of my invention is the provision of a device of the aforementioned character in which said slit is provided at one end of said window.

BRIEF DESCRIPTION OF THE DRAWINGS

Other objects and advantages of the invention will be apparent from the following specification and the accompanying drawings in which:

FIG. 1 shows the bottom of a sheet of identification bracelets;

FIG. 2 is an isometric bottom view of an identification bracelet after removal from the sheet;

FIG. 3 is a transverse sectional view taken on the broken line 3—3 of FIG. 2;

FIG. 4 is a longitudinal sectional view taken from the broken line 4—4 of FIG. 2; and FIG. 5 is a fragmentary view showing the top of the identification portion of the bracelet.

DESCRIPTION OF PREFERRED EMBODIMENT OF THE INVENTION

Referring to the drawing, and particularly to FIGS. 1–5 thereof, I show an identification bracelet 10 constructed in accordance with the teachings of the invention and including a strap portion 12 at one extremity and an identification portion 14 at the other extremity thereof.

The strap portion 12 incorporates spaced fastener receiving openings 16 for the reception of fastener means 18, said fastener means 18 consisting of a male member 20 and female receptacle 22 fabricated from a suitable plastic, such as high-density polyethylene, and operating as snap fasteners but incorporating self-locking means, not shown, to maintain the bracelet 10 in operative relationship with an object or person identified by the bracelet and to prevent the unauthorized removal thereof.

As previously indicated, the identification bracelets 10 are customarily fabricated from laminae of synthetic plastic sheet material and the sheet 30 of bracelets 10 shown in FIG. 1 of the drawings is typical of such fabrication. In the processing of the sheet material, a plurality of laminae is utilized to provide the necessary strength and flexibility in the bracelet 10. In the present embodiment of the bracelet 10, the superimposed sheets consist of an upper flexible transparent lamina 32, an intermediate transparent lamina 34, and a lower lamina 36, said laminae being alternatively referred to as, respectively, first, second, and third laminae.

As is well known to those skilled in the art, there is a wide variety of synthetic plastic sheet materials available for lamination, but I have found that the materials more suitable for the patent application bracelet of the present invention include transparent flexible polyethylene sheeting for the first lamina 32; transparent polyester sheeting for the intermediate or second lamina 34 and polyethylene sheeting for the third laminate 36. The polyester intermediate lamina 34 is intended to impart structural stability and strength to the bracelet 10. The first and second laminae 32 and 34 are transparent at least in the identification area, but the third lamina can be opaque or translucent or have applied decorative elements thereupon.

During the processing of the laminae prior to imparting to the sheets the precise configuration of the bracelets 10, a water-proof adhesive 37, FIG. 4, is applied to the upper surface of the lower or third lamina 36 and the intermediate lamina 34 is adhered to said upper surface from edge to edge of the resulting laminated structure, leaving a plurality of gaps 38 of rectangular configuration, as best shown in FIGS. 1 and 2 of the drawings.

After this lamination has been accomplished, the first, upper lamina 32 is ready to be applied to the upper surface of the intermediate lamina 34. However, prior to such application, a coating of adhesive is applied to said upper surface.

These gaps or uncoated portions 38 of the upper surface of the third lamina 36 are located at the identification portions 14 of the intermediate lamina 34.

When the first, uppermost lamina 32 is secured to the upper surface of the intermediate lamina 34, all of the first lamina 32 will be secured to the intermediate lamina 34, thus providing that the resulting bracelets 10 will be fabricated from laminae which are adhered to each other from one end of the bracelet to the other while still providing the unadhered areas 38.

As previously indicated, the unadhered area 38 lies below a transparent window 40 on the top of the bracelet 10 while simultaneously defining a pocket 42 for the reception of information means 44, in a manner to be described in greater detail below. Obviously while the utilization of three laminae to form a sheet 30 is described hereinabove, two or more than three laminae can be utilized, if necessary.

Because the manufacture of the bracelets 10 from the laminated sheet which results in the sheet of bracelets 30 requires that the strap portions 12 be formed in internesting relationship with the identification portions 14 being formed at the edges of the laminated sheet, the unadhered portions 38 are provided at the opposite edges of the sheet 30. After the lamination of the sheets has been completed, the laminate sheet is translated to die means (not shown) which form score lines 50 defining the final configuration of the bracelets 10. Subsequently, the fastener receiving openings 16 are formed in the strap portions 12. Access means 60 is provided in the window 40 by a slit 62 which constitutes the entrance to the pocket 42.

Fastener receiving openings are provided in the identification portion 14 of the bracelet 10 for the reception of the fastener means 18 and the sheets 30 are then cut to the desired number of bracelets 10 which can be separated from one another at the point of use.

A suitable water-base adhesive for use in laminating the plastic sheets is Lamal, which is manufactured by Morton Thiokol Corp.

One of the major advantages of the bracelet 10 is that it has a uniform profile and thickness in that no material is added to the bracelet to provide the windows and pockets thereupon. Obviously, the amount of material utilized in fabricating the bracelet is substantially reduced as is the amount of time consumed in the manufacture of the bracelets since the addition of the pocket material is obviated by the present integrated construction.

The utilization of the bracelet 10 involves the insertion of information means constituted by a card 46 through the slit 62 to locate it within the pocket 42 and beneath the viewing window 40. The card 46 should be slightly shorter than the length of the pocket 42 so that the slit can be returned to its substantially closed position by the subsidence of the window material.

It will be noted that the card 46 bears a bar code 48 but it is contemplated that various types of magnetic tape and other information storing and dispensing means may be utilized. For instance, the card 46 bearing a patient's name could contain imprinted patient information. Alternatively, data storing devices such as chips can be installed in the pocket in conjunction with a visually readable imprint of the patient's name.

I thus provide by my invention an identification bracelet which is characterized by the fact that it can be manufactured more cheaply and expeditiously than prior art devices by the elimination of additional material and additional steps to provide information containing pockets thereupon. Although I have described the invention as embodied in a hospital patient identification bracelet, it will be obvious to those skilled in the art that the device of the invention can be incorporated in a wide variety of identification articles and it is not intended that the scope of the invention be limited to the particular embodiment shown but that the invention be interpreted in the light of the disclosures and claims.

I claim:

1. In an identification wristband, the combination of: a first transparent, flexible lamina incorporating a transparent window portion and a strap portion; a second continuous, one-piece flexible lamina having a surface co-extensive with the surface of said first lamina, said surfaces other than adjacent said window portion being adhesively and permanently secured to each other for the entire areas of said first and second laminae, the unsecured areas of said first and second laminae defining a pocket between the underside of said window portion and the adjacent upper surface of said second lamina; and an opening in the unsecured area of one of said laminae communicating with said pocket.

2. The identification wristband of claim 1 in which an opening is provided in said second lamina to permit the insertion of information means into said pocket below said window.

3. The wristband of claim 2 in which said opening is at one end of said window.

4. In an identification wristband, the combination of: a first transparent lamina having a strap portion and an identification portion, said identification portion incorporating a transparent window area therein; a second continuous, one-piece lamina having a strap portion and an identification portion coextensive with corresponding portions of said first lamina, said first and second laminae, other than in said window area, being adhesively and permanently secured to each other from one to the other extremities thereof, there being a pocket between the unsecured areas of said window and said second lamina; and an opening in the unsecured area of one of said laminae communicating with said pocket.

5. The wristband of claim 4 in which an opening is provided in said second lamina for the insertion of information means below said window.

6. In an identification wristband, the combination of: a first transparent, flexible lamina having a strap portion at one extremity; an identification portion at the other extremity, said identification portion having a transparent window area therein; and a continuous, one-piece second lamina having strap and identification portions co-extensive with those of said first lamina, said first and second laminae strap and identification portions being adhesively and permanently secured to one another, said window area overlying an unsecured portion of said second lamina to provide a pocket between said first and second laminae; and an opening in the unsecured area of one of said laminae communicating with said pocket.

7. The identification wristband of claim 6 in which said strap and identification portions are provided with apertures for the reception of fastener means for maintaining said identification device in operative relationship with an object to be identified.

8. The identification wristband of claim 6 in which said pocket is provided with an access opening formed in one of said laminae.

9. The identification device of claim 8 in which said access opening is located adjacent one extremity of said window.

10. In a laminated identification wristband, the combination of: a first flexible transparent lamina having a transparent window area adjacent an extremity thereof, a second continuous one-piece flexible lamina adhesively and permanently secured in operative relationship with said first lamina and corresponding to the configuration of said first lamina, said first lamina being secured to said second lamina so that said window area of said first lamina overlying said second lamina is unsecured to the corresponding area of said second lamina to provide a pocket below said window with the remainders of said first and second laminae being secured to each other; and an opening in the unsecured area of one of said laminae communicating with said pocket.

11. The wristband of claim 10 in which said first and second laminae are provided with corresponding strap and identification portions and said window and pocket are located on said identification portion of said fret lamina.

12. The wristband of claim 10 in which an access opening to said pocket is provided in one of said laminae.

13. The wristband of claim 12 in which said access opening is located at one extremity of said window.

14. In a laminated identification wristband, the combination of: a top flexible, transparent lamina having a transparent window area adjacent an extremity thereof; an intermediate, continuous, one-piece flexible lamina adhesively and permanently secured in operative relationship with said top lamina and corresponding to the configuration thereof, said top lamina being secured to said intermediate lamina so that said window area of said top lamina overlying said intermediate lamina is unsecured to provide a pocket below said window; a bottom lamina of the same configuration as said top and intermediate laminae adhesively and permanently secured over its entire area to corresponding areas of said intermediate lamina; and an opening in the unsecured area of one of said laminae communicating with said pocket.

15. The wristband of claim 14 in which said first, second, and third laminae are provided with corresponding strap and identification portions and said window and pocket are located on and in said identification portion of said first lamina.

16. The wristband of claim 14 in which an access opening to said pocket is provided in one of said laminae.

17. The wristband of claim 16 in which said access opening is located at one extremity of said window.

* * * * *

UNITED STATES PATENT AND TRADEMARK OFFICE

CERTIFICATE OF CORRECTION

PATENT NO. : 5,581,924

DATED : December 10, 1996

INVENTOR(S) : Dean D. Peterson

It is certified that error appears in the above-indentified patent and that said Letters Patent is hereby corrected as shown below:

Column 1,
line 60, after "of", delete "lamina" and substitute --laminae--;
line 62, after "outer", delete "laminate" and substitute --lamina--; and
line 63, after "the", delete "lamina" and substitute --laminating--.

Column 3,
line 1, after "third", delete "laminate" and substitute --lamina--.

Column 5,
line 15, after "identification", delete "device" and substitute--wristband--;
line 20, after "thereof", add--and a strap portion at the other extremity thereof;--; and Column 6,
line 2, after "said", delete "fret" and substitute --first--.

Signed and Sealed this

Seventh Day of October, 1997

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,581,924
DATED : December 10, 1996
INVENTOR(S) : Dean D. Peterson

It is certified that error appears in the above-identified patent and that said Letters Patent is hereby corrected as shown below:

Column 2,
Line 58, after "transparent lamina", replace "32" with -- 36 --;
Line 59, after "lower lamina", replace "36" with -- 32 --; and
Line 66, after "first lamina", replace "32" with -- 36 --.

Column 3,
Line 1, after "third", replace "laminate 36" with -- lamina 32 --;
Line 3, after "second laminae", replace "32" with -- 36 --;
Line 10, after "third lamina", replace "36" with -- 32 --;
Line 16, after "upper lamina", replace "32" with -- 36 --;
Line 20, replace "third lamina 36" with -- second lamina 34 --;
Line 22, after "uppermost lamina", replace "32" with -- 36 --; and
Line 24 and 25, after "lamina 34", delete the rest of line 24 and all of line 25 from "all" on line 24 through "thus" at the end of line 25.

Column 4,
Line 41, after "provided in said", replace "second" with -- first --; and
Line 59, after "provided in said", replace "second" with -- first --.

Column 6,
Line 22, after "in which said first", delete the comma, and add -- and --; and
Line 23, delete the first two words, "and third".

Signed and Sealed this

Twenty-first Day of August, 2001

*Attest:*

Nicholas P. Godici

*Attesting Officer*

NICHOLAS P. GODICI
*Acting Director of the United States Patent and Trademark Office*